US007018282B1

(12) United States Patent
Drill et al.

(10) Patent No.: US 7,018,282 B1
(45) Date of Patent: Mar. 28, 2006

(54) CUSTOMIZED POLISHING PAD FOR SELECTIVE PROCESS PERFORMANCE DURING CHEMICAL MECHANICAL POLISHING

(75) Inventors: Charles Franklin Drill, Boulder Creek, CA (US); Milind Weling, San Jose, CA (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 08/824,633

(22) Filed: Mar. 27, 1997

(51) Int. Cl.
*B24D 11/00* (2006.01)

(52) U.S. Cl. ..... 451/529; 451/530; 451/533; 451/539

(58) Field of Classification Search ..... 451/526, 451/529, 530, 533, 539
See application file for complete search history.

(56) References Cited

U.S. PATENT DOCUMENTS 959,054 A * 5/1910 Glover ..... 451/530
5,212,910 A * 5/1993 Breivogel et al. ..... 451/539
5,287,663 A * 2/1994 Pierce et al. ..... 451/539
5,390,449 A * 2/1995 Hilton ..... 451/539
5,421,769 A * 6/1995 Schultz et al. ..... 451/526
5,534,106 A * 7/1996 Cote et al. ..... 451/533
5,564,965 A * 10/1996 Tanaka et al. ..... 451/533
5,578,099 A * 11/1996 Neff ..... 451/530
5,609,517 A * 3/1997 Lofaro ..... 451/529
5,664,989 A * 9/1997 Nakata et al. ..... 451/533

* cited by examiner

*Primary Examiner*—M. Rachuba
(74) *Attorney, Agent, or Firm*—Peter Zawilski

(57) ABSTRACT

The present invention comprises a customized polishing pad for use in a wafer polishing machine. The polishing pad of the present invention includes a polishing surface integral with the polishing pad. The polishing surface is adapted to frictionally contact a wafer in the polishing machine, thereby polishing the wafer. The polishing surface of the polishing pad includes at least two areas, where each area is adapted to frictionally contact the wafer and achieve a polishing effect specific for that area. A customized polishing effect is achieved by the polishing pad of the present invention when the wafer is selectively moved frictionally against the at least two areas by the wafer polishing machine.

12 Claims, 9 Drawing Sheets

CUSTOMIZED POLISHING PAD FOR SELECTIVE PROCESS PERFORMANCE DURING CHEMICAL MECHANICAL POLISHING

TECHNICAL FIELD

The field of the present invention pertains to semiconductor fabrication processing. More particularly, the present invention relates to a system for utilizing customized polishing pads for selective process performance during polishing of a semiconductor wafer in a chemical mechanical polishing (CMP) machine.

BACKGROUND ART

Most of the power and usefulness of today's digital IC devices can be attributed to the increasing levels of integration. More and more components (resistors, diodes, transistors, and the like) are continually being integrated into the underlying chip, or IC. The starting material for typical ICs is very high purity silicon. The material is grown as a single crystal. It takes the shape of a solid cylinder. This crystal is then sawed (like a loaf of bread) to produce wafers typically 10 to 30 cm in diameter and 250 microns thick.

The geometry of the features of the IC components are commonly defined photographically through a process known as photolithography. Very fine surface geometries can be reproduced accurately by this technique. The photolithography process is used to define component regions and build up components one layer on top of another. Complex ICs can often have many different built up layers, each layer having components, each layer having differing interconnections, and each layer stacked on top of the previous layer. The resulting topography of these complex IC's often resemble familiar terrestrial "mountain ranges", with many "hills" and "valleys" as the IC components are built up on the underlying surface of the silicon wafer.

In the photolithography process, a mask image, or pattern, defining the various components, is focused onto a photosensitive layer using ultraviolet light. The image is focused onto the surface using the optical means of the photolithography tool, and is imprinted into the photosensitive layer. To build ever smaller features, increasingly fine images must be focused onto the surface of the photosensitive layer, i.e. optical resolution must increase. As optical resolution increases, the depth of focus of the mask image correspondingly narrows. This is due to the narrow range in depth of focus imposed by the high numerical aperture lenses in the photolithography tool. This narrowing depth of focus is often the limiting factor in the degree of resolution obtainable, and thus, the smallest components obtainable using the photolithography tool. The extreme topography of complex ICs, the "hills[†] and "valleys," exaggerate the effects of decreasing depth of focus. Thus, in order to properly focus the mask image defining sub-micron geometry's onto the photosensitive layer, a precisely flat surface is desired. The precisely flat (i.e. fully planarized) surface will allow for extremely small depths of focus, and in turn, allow the definition and subsequent fabrication of extremely small components.

Chemical-mechanical polishing (CMP) is the preferred method of obtaining full planarization of a wafer. It involves removing a sacrificial layer of dielectric material using mechanical contact between the wafer and a moving polishing pad saturated with slurry. Polishing flattens out height differences, since high areas of topography (hills) are removed faster than areas of low topography (valleys). Polishing is the only technique with the capability of smoothing out topography over millimeter scale planarization distances leading to maximum angles of much less than one degree after polishing.

Prior Art FIG. 1A shows a top view of a CMP machine 100 and Prior Art FIG. 1B shows a side section view of the CMP machine 100 taken through line BB of Prior Art FIG. 1A. CMP machine 100 is fed wafers to be polished. CMP machine 100 picks up the wafers with an arm 101 and places them onto a rotating polishing pad 102. Polishing pad 102 is made of a resilient material and is textured, often with a plurality of predetermined groves, to aid the polishing process. Polishing pad 102 rotates on a platen 104, or turn table located beneath polishing pad 102, at a predetermined speed. A wafer 105 is held in place on polishing pad 102 and arm 101. The lower surface of wafer 105 rests against polishing pad 102. The upper surface of wafer 105 is against the lower surface of a wafer carrier 106 of arm 101. As polishing pad 102 rotates, arm 101 rotates wafer 105 at a predetermined rate. Arm 101 forces wafer 105 into polishing pad 102 with a predetermined amount of down force. CMP machine 100 also includes a slurry dispense arm 107 extending across the radius of polishing pad 102. Slurry dispense arm 107 dispenses a flow of slurry onto polishing pad 102.

CMP is the preferred method of obtaining full wafer planarization, as described above, and is currently the only technique capable of over millimeter scale planarization after polishing. Hence, CMP is increasingly being used for planarizing dielectrics and other layers, particularly for applications using 0.35 μm and smaller semiconductor fabrication process technologies. Such applications include, for example, using CMP to planarize the trench oxide fill for a shallow trench isolation process.

As applications for CMP continue to increase, the specific CMP performance requirements for the individual process steps demand a specific set of process conditions and consumables (e.g., polishing slurry, polishing agents, and the like). Additionally, as semiconductor fabrication technology advances, many process requirements (such as global planarity, non-uniformity, edge exclusion, and the like) become increasingly stringent. These conditions often require unique optimization of process conditions. For example. CMP performance requirements are even more stringent with sub-0.35 μm semiconductor fabrication process technologies. The narrowing depth of focus at such resolutions requires optimal planarization performance from the CMP process.

One method of optimizing the CMP process for the differing devices is to have a uniquely optimized CMP machine for each particular device being fabricated. With individual, uniquely optimized CMP machines, the variables of the CMP process can be finely tuned for the requirements of the particular device being fabricated. Wafers containing devices of one type are thereby uniquely polished in relation to wafers containing devices of another type.

It is possible to use multiple individually tailored CMP machines or even a single CMP machine with multiple individually tailored polishing platens. Such machines, however, are not practical. The capitol equipment costs, wafer throughput, fabrication facility floor space requirements, and operator training expenses of such machines each tend to outweigh the achievable benefits.

Thus, what is required is a system which can be readily optimized for differing CMP process requirements. The required system should be readily tunable for differing devices being polished. The required system should be tailorable, depending upon the requirements of the particular devices being polished, without adversely impacting wafer throughput. Additionally, the required system should have minimal added capitol equipment costs, should not require increased fabrication facility floor space, or adversely impact operator training expenses. The present invention provides a novel solution to the above requirements.

DISCLOSURE OF THE INVENTION

The present invention comprises a customized polishing pad for use in a wafer polishing machine. The present invention provides a readily optimized system for differing CMP process requirements. The system of the present invention is readily tunable for each differing device being polished in the CMP process. The system of the present invention is tailorable, depending upon the requirements of a particular device being polished, without adversely impacting CMP process wafer throughput. Additionally, the system of the present invention has minimal added capitol equipment costs, does not require increased fabrication facility floor space, and does not adversely impact operator training expenses.

In one embodiment, the polishing pad of the present invention includes a polishing surface integral with the polishing pad. The polishing surface is adapted to frictionally contact a wafer in the polishing machine, thereby polishing the wafer. The polishing surface of the polishing pad includes two areas with each area adapted to frictionally contact the wafer and achieve a polishing effect specific for that area. A customized polishing effect is achieved by the polishing pad of the present invention and the CMP machine when the wafer is selectively moved frictionally against the two areas by the wafer polishing machine. The wafer is polished in one of the two areas and then the other of the two areas for controlled amounts of time in order to achieve the customized polishing effect. By controlling and adjusting the area on the polishing surface on which the wafer is polished, the system of the present invention is readily tunable for each differing device being polished in the CMP process.

BRIEF DESCRIPTION OF THE DRAWINGS

The present invention is illustrated by way of example and not by way of limitation, in the figures of the accompanying drawings and in which like reference numerals refer to similar elements and in which.

Prior art

Prior art

BEST MODE FOR CARRYING OUT THE INVENTION

A method and system for a customized polishing pad for use in a wafer polishing machine is disclosed. In the following description, for the purposes of explanation, numerous specific details are set forth in order to provide a thorough understanding of the present invention. It will be obvious, however, to one skilled in the art that the present invention may be practiced without these specific details. In other instances, well-known structures, devices, and processes are shown in block diagram form in order to avoid unnecessarily obscuring the present invention.

Chemical-mechanical polishing (CMP) is the preferred method of obtaining full planarization of a semiconductor wafer containing devices for fabrication processing. The CMP process involves removing all, or a portion of, a layer of dielectric material using mechanical contact between the wafer and a moving polishing pad saturated with a polishing slurry. Polishing through the CMP process flattens out height differences, since high areas of topography (hills) are removed faster than areas of low topography (valleys). The CMP process has the capability of smoothing out topography over millimeter scale planarization distances, leading to maximum angles of much less than one degree after polishing.

The present invention comprises a customized polishing pad for use in a CMP machine (or other wafer polishing machines). The present invention provides a readily optimized system for differing CMP process requirements. The system of the present invention is readily tunable for each differing device being polished in the CMP process. The system of the present invention is tailorable, depending upon the requirements of the particular devices being polished, without adversely impacting CMP process wafer throughput. Additionally, the system of the present invention has minimal added capitol equipment costs, does not require increased fabrication facility floor space, and does not adversely impact operator training expenses. The present invention and its benefits are described in greater detail below.

Figure 1A:
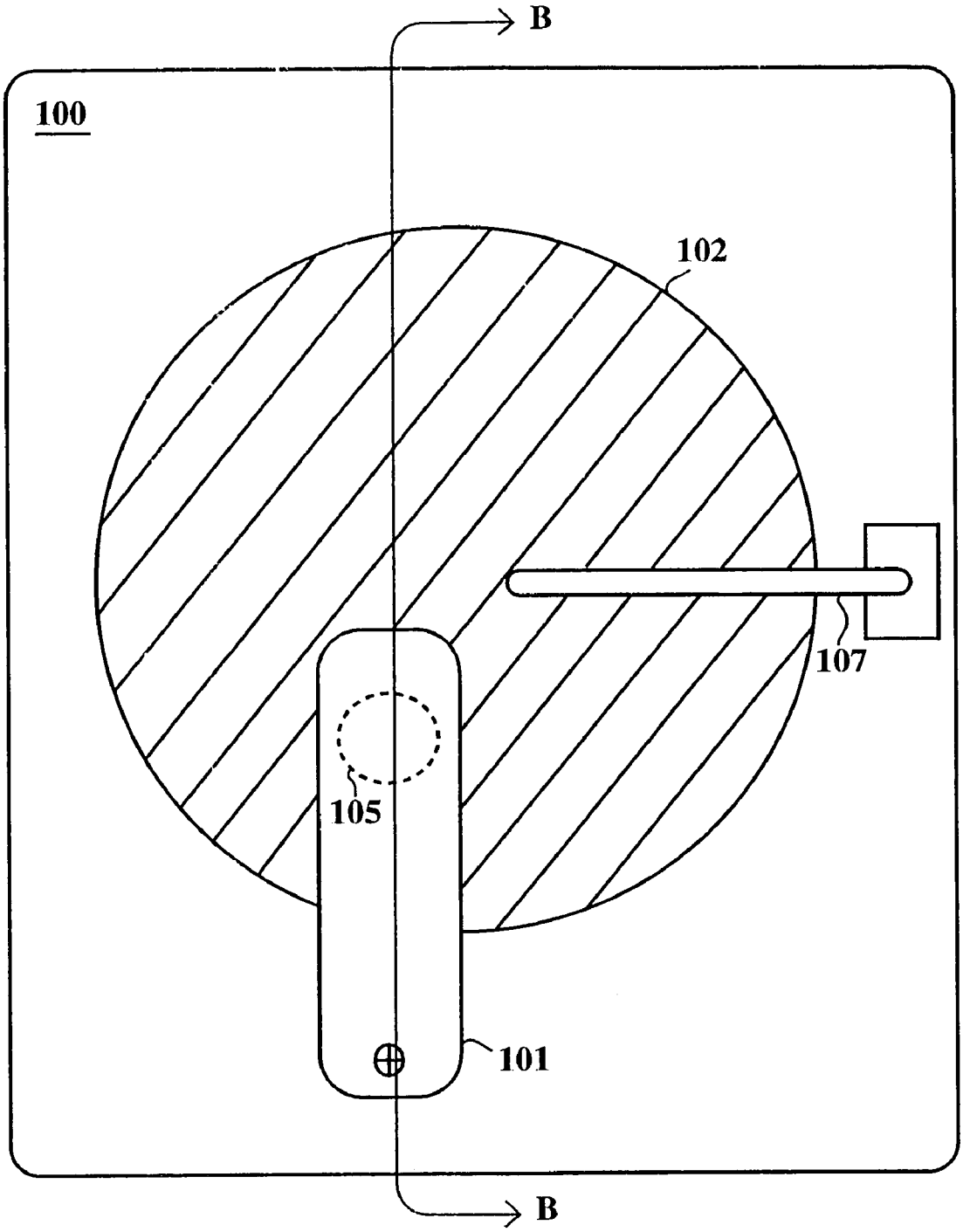
FIG. 1A (Prior Art)
FIG. 1A shows a top view of a prior art CMP machine.
Figure 1B:
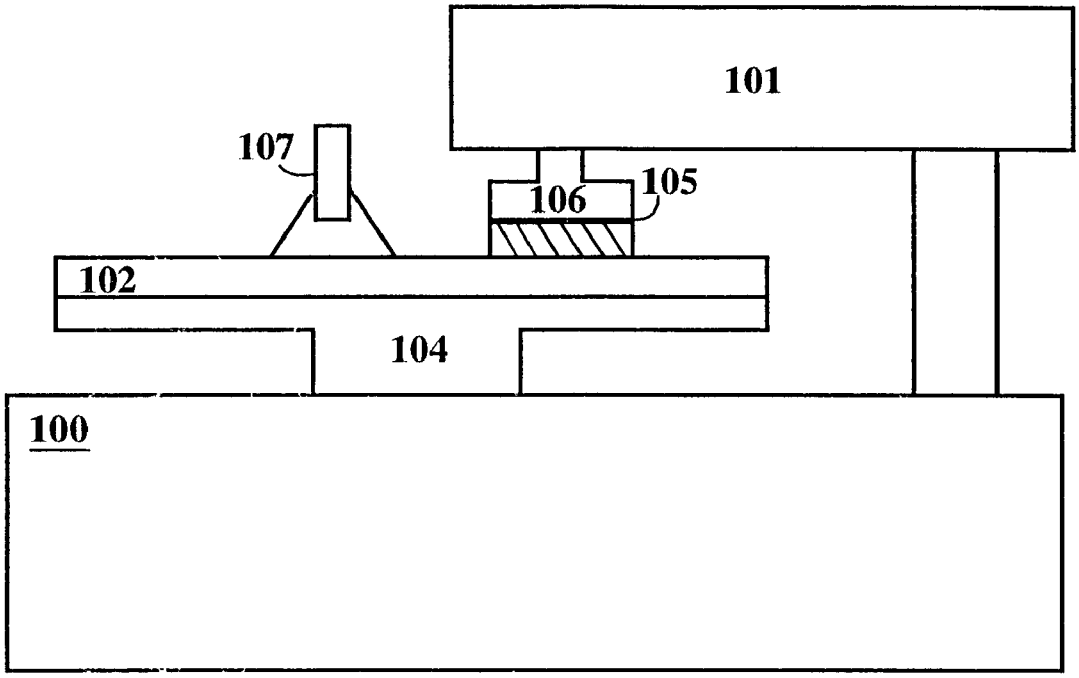
FIG. 1B (Prior Art)
FIG. 1B shows a side section view of the prior art CMP machine of FIG. 1A taken through line BB.
Figure 2A:
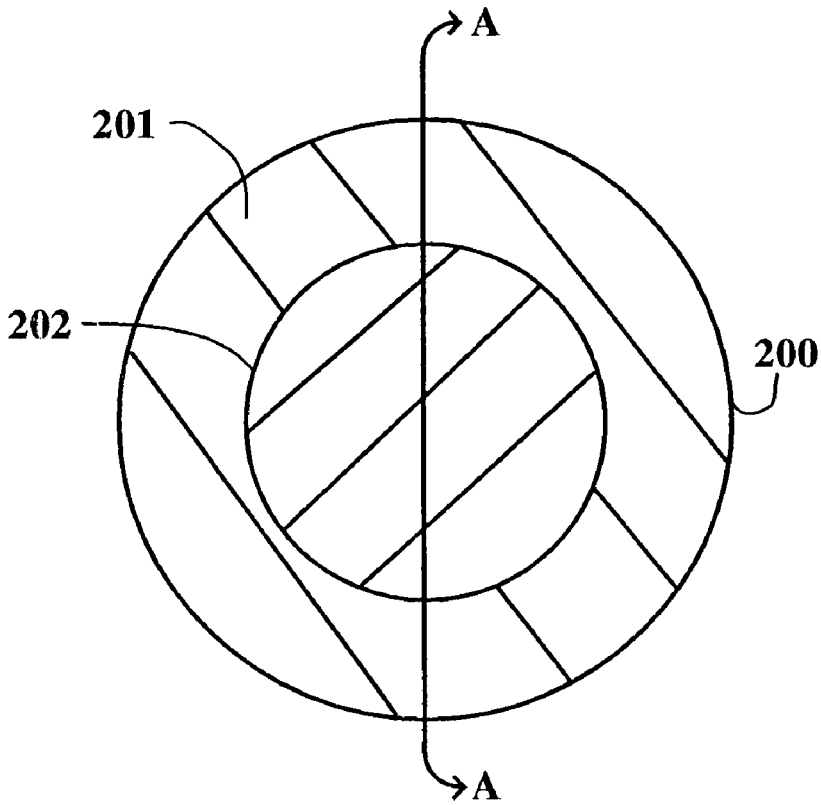
FIG. 2A shows a customized polishing pad in accordance with one embodiment of the present invention.

Referring to FIG. 2A, a customized polishing pad in accordance with one embodiment of the present invention is shown. Customized polishing pad 200 includes a first customized region 201 and a second customized region 202 concentrically within the first region 201. The first region 201 and the second region 202 are both integral with the surface of the polishing pad 200. The first region 201 and second region 202 each have differing polishing characteristics.

Figure 2B:
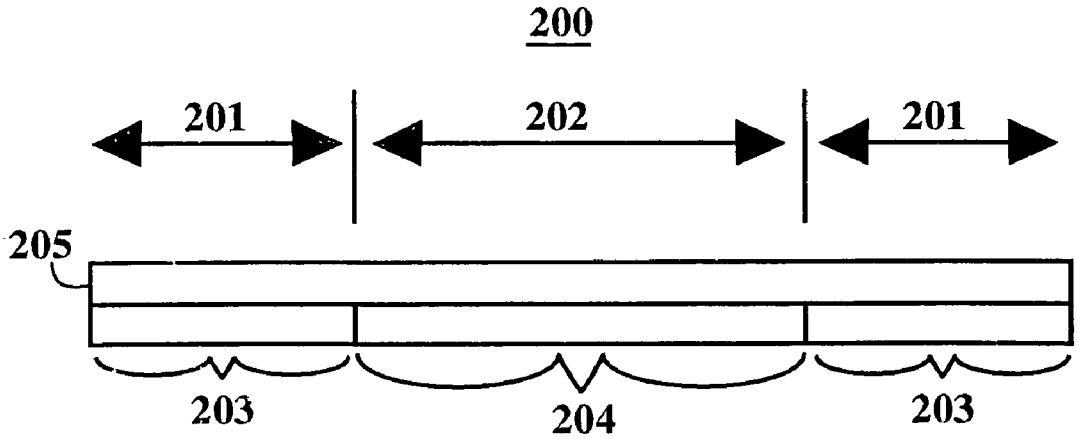
FIG. 2B shows a side section view of the customized polishing pad of FIG. 2A taken through line AA.

With reference now to FIG. 2B, a side section view of customized polishing pad 200 through line AA is shown. In the present embodiment, customized polishing pad 200 includes a first underlying layer 203 and a second underlying layer 204. The first underlying layer 203 and second underlying layer 204 are each "covered" by an overlying layer 205. The first underlying layer 203 is directly beneath the first region 201 and the second underlying layer 204 is directly beneath the second region 202. The second underlying layer 204 is located concentrically within first underlying layer 203. The characteristics of the first underlying layer 203 largely determines the characteristics of the first region 201. Similarly, the characteristics of second underlying layer 204 determines the characteristics of second region 202. In the present embodiment, the first underlying layer 203 of customized polishing pad 200 is comprised of a firmer, less resilient material, while the second underlying layer 204 is comprised of a softer, more resilient material. The overlying layer 205 is comprised of material having uniform, homogenous qualities across the area of its surface. In the present embodiment, overlying layer 205 provides the polishing surface for wafer polishing.

Figure 3:
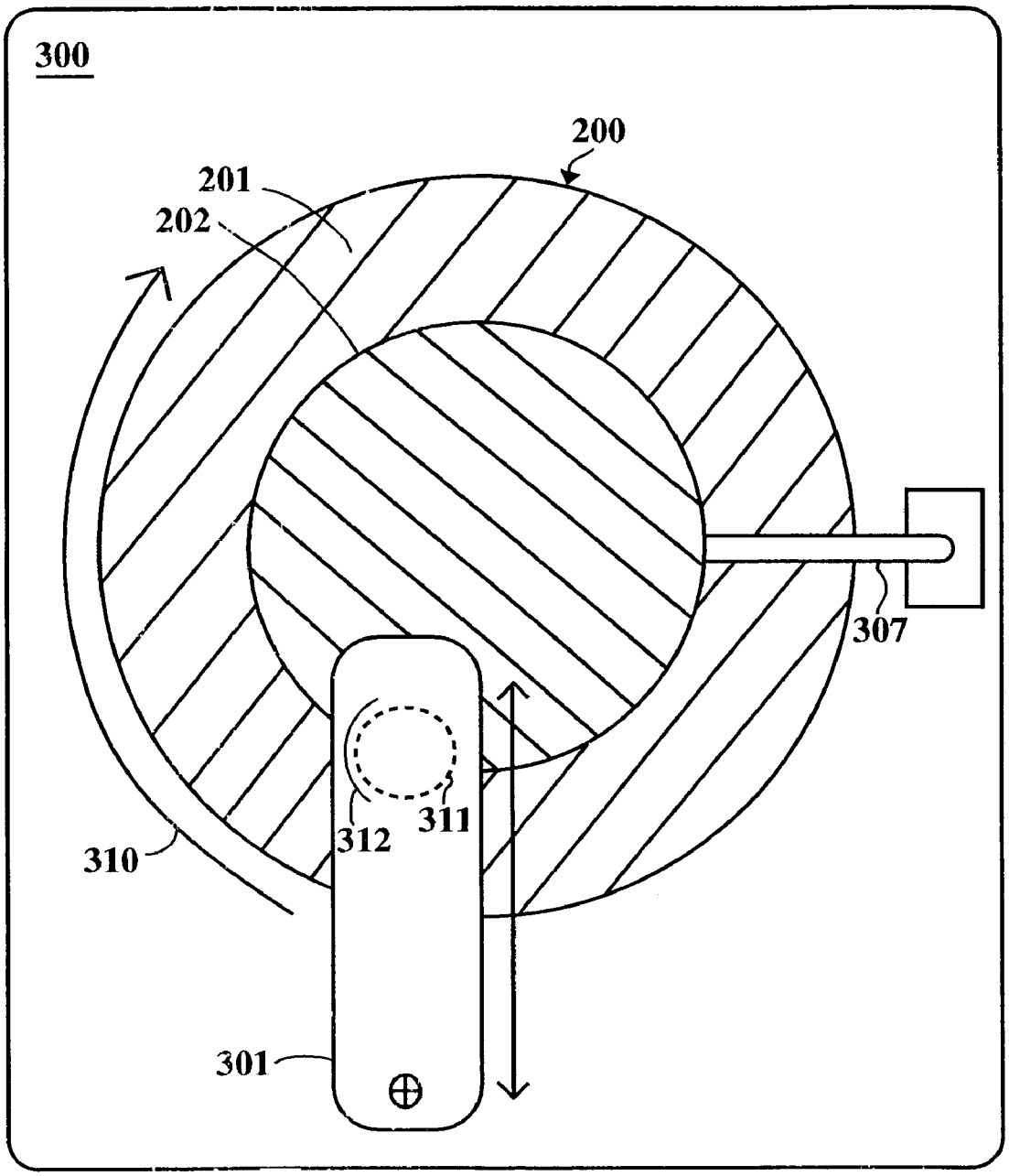
FIG. 3 shows a top view of a CMP machine using a customized polishing pad in accordance with one embodiment of the present invention.

FIG. 3 shows a top view of a CMP machine 300 using the customized polishing pad 200 in accordance with one embodiment of the present invention. The CMP machine 300 picks up wafers with an arm 301 and places them onto the rotating customized polishing pad 200. The customized polishing pad 200 rotates on a platen, located beneath customized polishing pad 200, at a predetermined speed. The arm 301 forces a wafer 311 into the customized polishing pad 200 with a predetermined amount of downward force. The lower surface of wafer 311 rests against customized polishing pad 200. The upper surface of wafer 311 is against the wafer carrier of arm 301. As customized polishing pad 200 rotates (as shown by arrow 310) arm 301 rotates wafer 311 at a predetermined rate (as shown by arrow 312). Simultaneously, arm 301 moves wafer 311 toward and away from the center of customized polishing pad 200 (as shown by arrow 313). The CMP machine 300 also includes a slurry dispense arm 307 extending across the radius of customized polishing pad 200. The slurry dispense arm 307 dispenses a flow of slurry onto customized polishing pad 200.

The slurry is a mixture of de-ionized water and polishing agents designed to chemically aid the smooth and predictable planarization of the wafer. The rotating action of both customized polishing pad 200 and wafer 311, in conjunction with the polishing action of the slurry, combine to planarize, or polish, wafer 311 at some nominal rate. This rate is referred to as the removal rate. A constant and predictable removal rate is important to the uniformity and throughput performance of the wafer fabrication process. The removal rate should be expedient, yet yield precisely planarized wafers, free from surface anomalies. If the removal rate is too slow, the number of planarized wafers produced in a given period of time decreases, hurting wafer through-put of the fabrication process. If the removal rate is too fast, the CMP planarization process will not be uniform across the surface of the wafers, hurting the yield of the fabrication process. Regions 201 and 202 of customized polishing pad 200 of the present invention greatly aid the process of maintaining a stable and uniform removal rate.

Figure 4A:
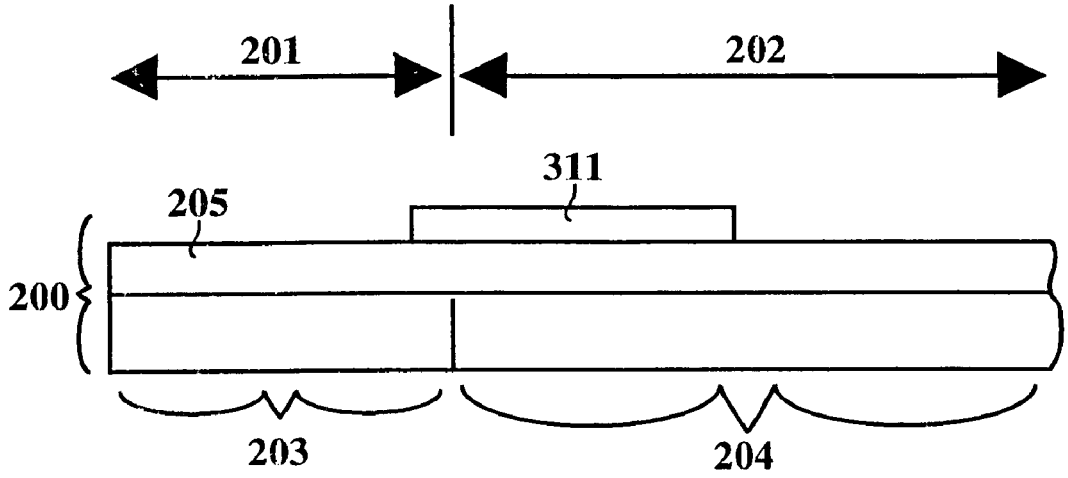
FIG. 4A shows a first side view of a portion of the customized polishing pad of the present invention.
Figure 4B:
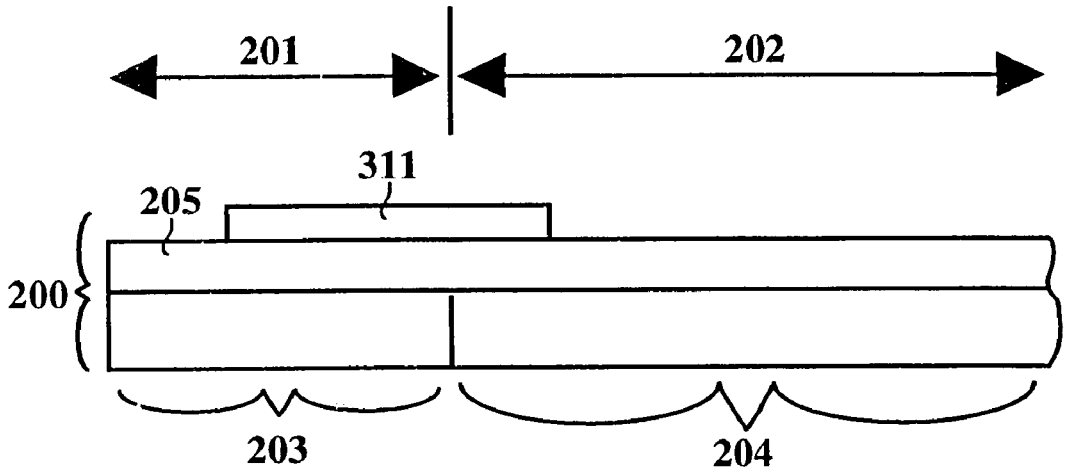
FIG. 4B shows a second side view of the portion of the customized polishing pad from FIG. 4A.

With reference now to FIG. 4A and FIG. 4B, a first side view of a portion of the customized polishing pad 200 of the present invention with wafer 311 and a second side view of the portion of the customized polishing pad 200 with wafer 311 are respectively shown. FIG. 4A and FIG. 4B each show a portion of customized polishing pad 200. As described above, customized polishing pad 200 includes overlying layer 205 and first underlying layer 203 and second underlying layer 204. In addition, customized polishing pad 200 includes first region 201 and second region 202.

The customized polishing pad 200 of the present invention aids the process of maintaining a stable and uniform removal rate while polishing wafer 311 by providing polishing regions of differing characteristics. These polishing regions are used by CMP machine 300 to compensate for any non-uniform polishing characteristics present in the CMP process. In the present embodiment, the differing polishing regions are provided by region 201 and region 202. Thus, CMP machine 300 selectively polishes wafer 311 using region 201 and 202 such that the combined polishing action of regions 201 and 202 compensate for any non uniform polishing characteristics. This is shown by the position of the wafer 311 with respect to customized polishing pad 200 in FIG. 4A and FIG. 4B. For example, the CMP process often causes unstable removal rates due to the differing linear velocity of the edges of wafer 311 relative to the center. The differing linear velocity is due to the rotational movement of wafer 311 by CMP machine 300 during the polishing process. By selectively using the different polishing characteristics of regions 201 and 202 of customized polishing pad 200, this differing linear velocity is compensated for. Also, by selectively adjusting the location of the wafer 311 with respect to the radius of the polishing pad 200, the differing linear velocity is compensated for. It should be noted, however, that the differing linear velocity can be utilized by the system of the present invention in conjunction with the differing polishing characteristics of the regions 201 and 202 to provide a customized polishing effect.

In addition to the differing linear velocities, customized polishing pad 200 of the present invention is used to compensate and adjust for additional variables present in the CMP process. An acceptable post-CMP surface of wafer 311 is obtained when enough oxide (or other surface layer material) has been removed such that the "hills" and "valleys" of the original topography are erased. Hills are removed more quickly than valleys since the removal rate is greater for higher structures on the surface of wafer 311 and less for lower structures.

During the CMP process, the amount of oxide removed needs to be closely controlled. If the removal rate is less than nominal, unwanted surface topography remains after polishing. If the removal rate is greater than nominal, wafer 311 may be left with excessively thin remaining inter-metal dielectric (IMD). The consequences of failing to meet proper planarity or uniformity requirements can be metal stringers or inter-metal layer shorts in the devices on the surface of wafer 311. In addition, inadequate surface layer thickness control can lead to excessive variation in the inter-layer capacitance, which in turn leads to circuit performance problems in the fabricated devices.

The quality of post CMP process planarity is characterized in terms of step height ratio (SHR) and planarization distance (PD). SHR is zero for the case of perfect, long range planarization across the surface of wafer 311 and is one when there is no long range planarization. For example, SOG (Spin-on-glass) planarization, as opposed to CMP, only smoothes out local topography and does not create long range planarization, hence, it has an SHR close to one. The SHR of a CMP process can range from zero to one depending upon the polishing process, type of polishing pad and the amount of material removed during polishing.

The PD is defined as the distance at which the post-polish step height of a "semi-infinite" step is realized. A long PD is desirable since variations in topography over areas that are much smaller than the PD will be completely planarized during polishing. The PD of a CMP process ranges from a few hundred microns to several millimeters across the surface of a wafer, depending upon the desired result.

The WID (within a die) uniformity largely depends upon the actual integrated circuit topography and the SHR and PD. For example, the remaining oxide thickness (or step height) is greater on wider integrated circuit structures, such as a wide metal pad, and is less on narrower integrated circuit structures, such as isolated narrow lines. The WID uniformity (and SHR after polish) also depend upon the density of the underlying topography of the integrated circuit. Areas with lower metal line density polish faster than areas with dense, underlying integrated circuit topography. Hence, with prior art CMP processing, each wafer having differing integrated circuits fabricated on its surface will have a slightly different WID non-uniformity, due to variations in the size and density of its interconnects, metal lines, and other integrated circuit topography.

Thus, it should be noted that with respect to typical prior art CMP processes, a harder, less compressible polishing pad results in lower SHR and longer PD. This leads to improved WID thickness uniformity but less within a wafer (WIW) planarization uniformity. A softer, more compressible polishing pad yields higher SHR, and shorter PD. Hence, with prior art CMP processes, there is a trade off between improving WID uniformity and WIW uniformity.

Referring still to FIG. 4A and FIG. 4B, the customized polishing pad 200 of the present invention, however, readily optimizes the CMP process of CMP machine 300 for either improved WID uniformity or improved WIW uniformity. As described above, in the present embodiment, first underlying layer 203 is comprised of a harder, less resilient material while second underlying layer 204 is comprised of a softer more resilient material. Thus, the amount of time wafer 311 polished using first region 201 and the amount of time wafer 311 is polished using second region 202 is controlled by CMP machine 300 to yield the optimized degree of WID uniformity and the optimized degree of WIW uniformity.

Hence, customized polishing pad 200, by providing both a harder first region 201 and a softer second region 202, provides a system which is readily tunable for each differing device or each differing wafer being processed. By providing both optimized WID uniformity and optimized WIW uniformity on a single CMP machine (e.g., CMP machine 300), the customized polishing pad 200 of the present invention does not adversely impact wafer throughput by requiring the use of multiple CMP processes on multiple CMP machines. Additionally, CMP processing in accordance with the present invention does not require the purchase of additional equipment (e.g., additional CMP machines with specific prior art polishing pads or a CMP machine with multiple polishing platens). Thus, fabrication facility floor space requirements are riot increased and operator training costs are not adversely impacted.

Figure 5A:
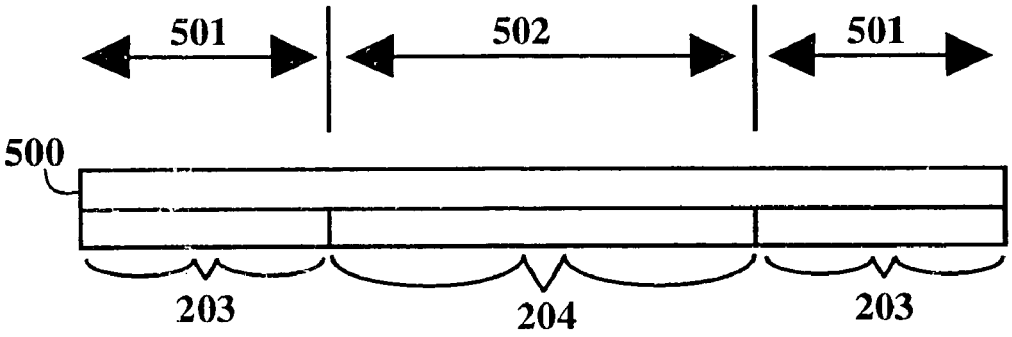
FIG. 5A shows a side view of an overlying layer in accordance with one alternate embodiment of the customized polishing pad of the present invention.

With reference now to FIG. 5A, a side view of an overlying layer 500 in accordance with one alternate embodiment of the customized polishing pad of the present invention is shown. Overlying layer 500, in a manner similar to overlying layer 205, includes a first region 501 and a second region 502. First region 501 directly overlies first underlying layer 203 and second region 502 directly overlies second underlying layer 204. Overlying layer 500, however, has differing textures across its surface.

Figure 5B:
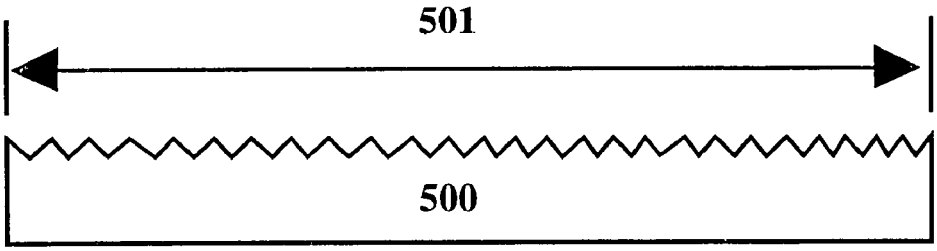
FIG. 5B shows a detailed side view of the surface texture of a first region of the overlying layer from FIG. 5A.
Figure 5C:
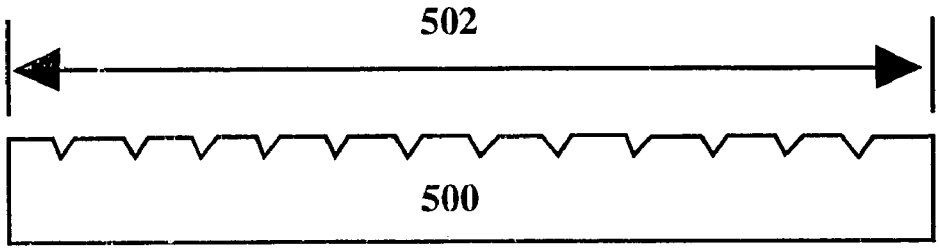
FIG. 5C shows a detailed side view of the surface texture of a second region of the overlying layer from FIG. 5A.

FIG. 5B shows a detailed side view of the surface texture of first region 501 and FIG. 5C shows a detailed side view of the surface texture of second region 502. Region 501 has a rougher predefined surface texture in comparison to region 502. Thus, in addition to being firmer because of underlying layer 203, region 501 has a rougher surface texture which increases the removal rate during CMP processing. The amount of time a wafer is polished using first region 501 and the amount of time the wafer is polished using second region 502 is controlled by CMP machine 300 to yield the optimized degree of WID uniformity and the optimized degree of WIW uniformity. Hence, a customized polishing pad in accordance with the present embodiment provides regions of differing surface texture in addition to differing hardness.

Accordingly, it should be appreciated that the customized polishing pad is well suited to differing combinations of surface texture, layer thickness, and layer hardness without departing from the scope of the present invention. For example, the customized polishing pad of the present invention can provide its benefits through having an overlying layer in accordance with overlying layer 500 and a single underlying layer of uniform hardness. In such an embodiment, the texture of regions 501 and 502 are used to provide the optimal degree of WIW and WID uniformity. Additionally, for example, the underlying layers 203 and 204 can be of differing thickness, providing an uneven polishing surface with respect to regions 501 and 502. Similarly, the overlying layer 500 can be omitted entirely, and the upper surfaces of the underlying layers 203 and 204 are used as the polishing surface. Hence, it should be appreciated that any differing quality which affects the polishing characteristics of the respective regions (e.g., regions 501 and 502) can be used by the present invention to provide a customized polishing effect.

Figure 6:
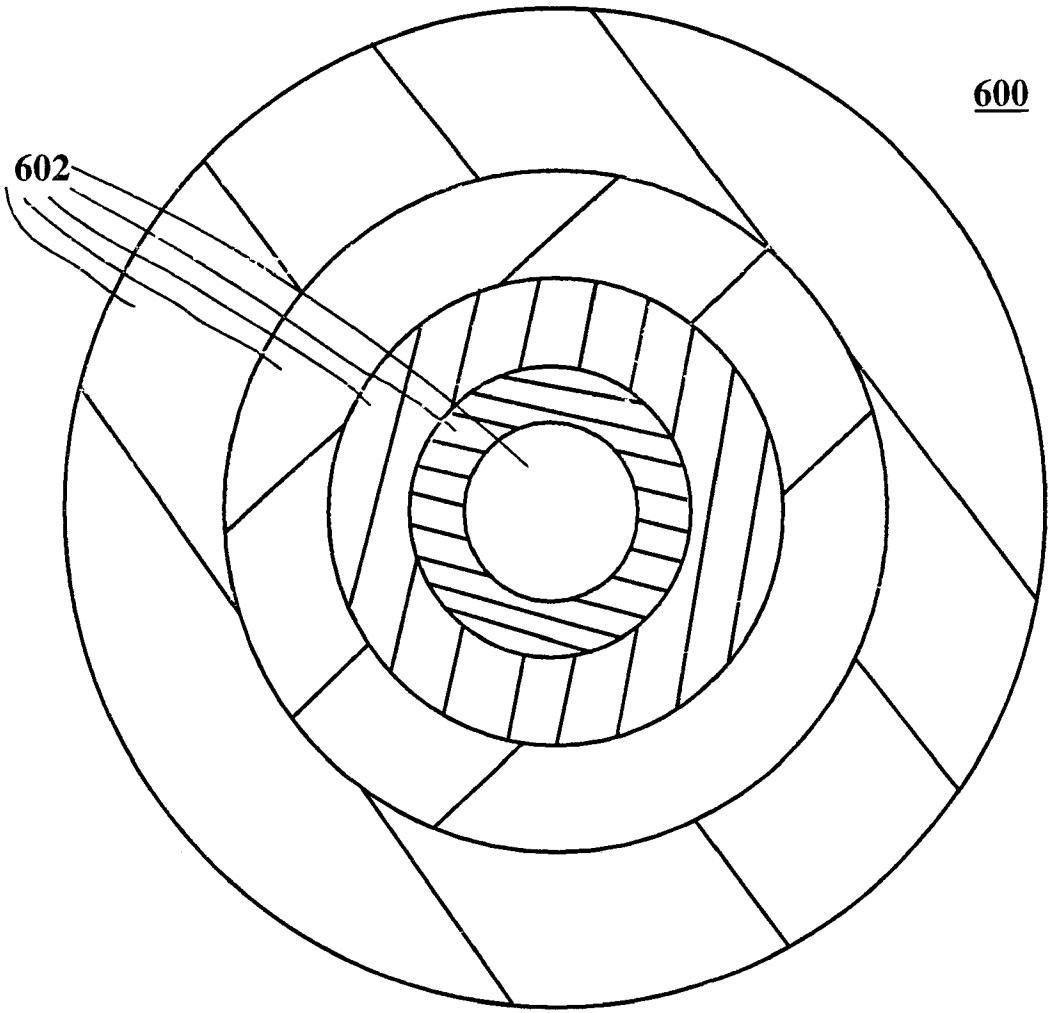
FIG. 6 shows a top view of a multi-region customized polishing pad in accordance with another alternate embodiment of the present invention.

Referring now to FIG. 6, a top view of a multi-region customized polishing pad 600 in accordance with another alternate embodiment of the present invention is shown. The customized polishing pad 600 includes a plurality of regions 602 located concentrically within one another. Thus, customized polishing pad 600, as opposed to customized polishing pad 200, includes more than two distinct polishing regions 602, where each of the plurality of regions 602 is of a specific predetermined hardness to effect a specific WIW and WID uniformity. In this manner, customized polishing pad 602 provides a greater selection of regions for polishing a wafer. The greater selection of regions allows a CMP machine using customized polishing pad 600 to more finely "tune" the CMP process for a specific wafer. In the present embodiment, the plurality of regions 602 differ with respect to hardness. It should be appreciated, however, that the plurality of regions 602 can differ with respect to various combinations of surface texture, layer hardness, or layer thickness without departing from the scope of the present invention.

Figure 7A:
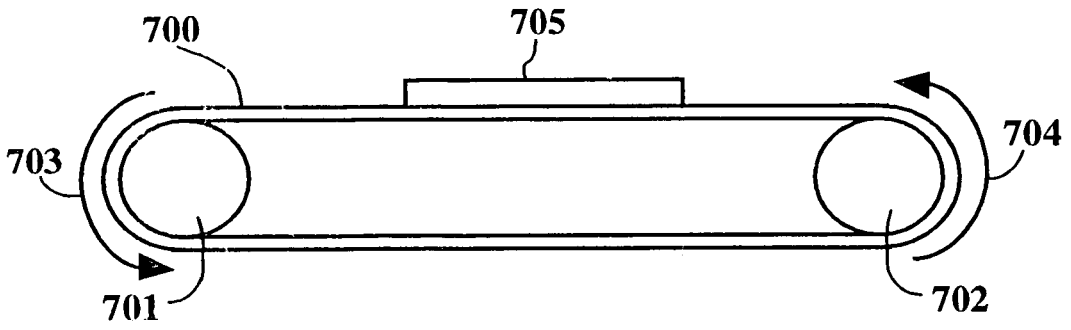
FIG. 7A shows a side view of yet another embodiment of the customized polishing pad of the present invention.

Referring now to FIG. 7A, a side view of a customized polishing pad 700 in accordance with another alternate embodiment of the present invention is shown. The customized polishing pad 700 is used in a "linear" CMP machine as opposed to a "polar" CMP machine (e.g., CMP machine 300 of FIG. 3) or an "orbital" CMP machine. In the linear CMP machine, two rollers 701 and 702 continuously move customized polishing pad 700 in the manner shown by arrows 703 and 704. A wafer 705 is held against customized polishing pad 700 for polishing. The linear CMP machine functions similarly to the polar CMP machine except for the nature of the movement of customized polishing pad 700.

Figure 7B:
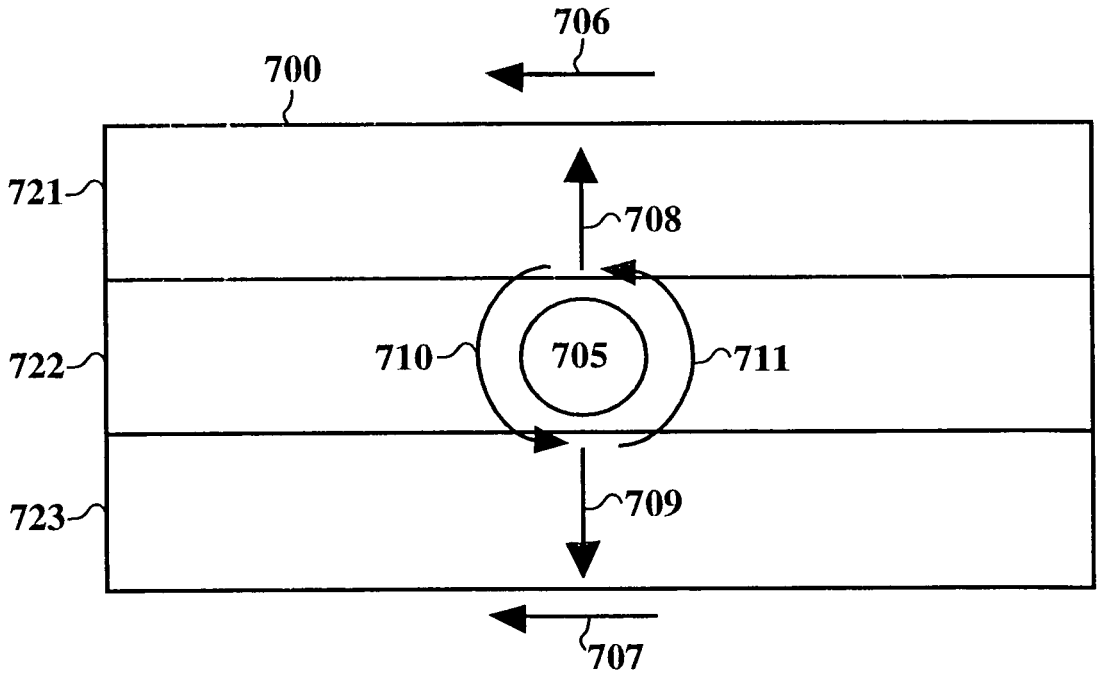
FIG. 7B shows a top view of the customized polishing pad from FIG. 7A.

Referring now to FIG. 7B, a top view of customized polishing pad 700 is shown. Customized polishing pad 700 moves with respect to wafer 705 as shown by arrows 706 and 707. Wafer 705 is translated across customized polishing pad 700 by the linear CMP machine in the manner shown by arrows 708 and 709, and is continually rotated as shown by arrows 710 and 711.

In the present embodiment, customized polishing pad 700 includes regions 721, 722, and 723. Each of regions 721, 722, and 723, has a different degree of hardness. Thus, the amount of time wafer 705 is polished using each of areas 721, 722, and 723 is controlled by the linear CMP machine to yield the optimized degree of WID uniformity and the optimized degree of WIW uniformity. Hence, customized polishing pad 700 functions in a manner similar to customized polishing pad 200. In addition, as described above, it should be appreciated that regions 721, 722, and 723 can differ with respect to surface texture, layer hardness, or layer thickness without departing the scope of the present invention. Thus, it should be appreciated that the present invention is well suited to use in linear, polar, or orbital CMP machines.

Figure 8:
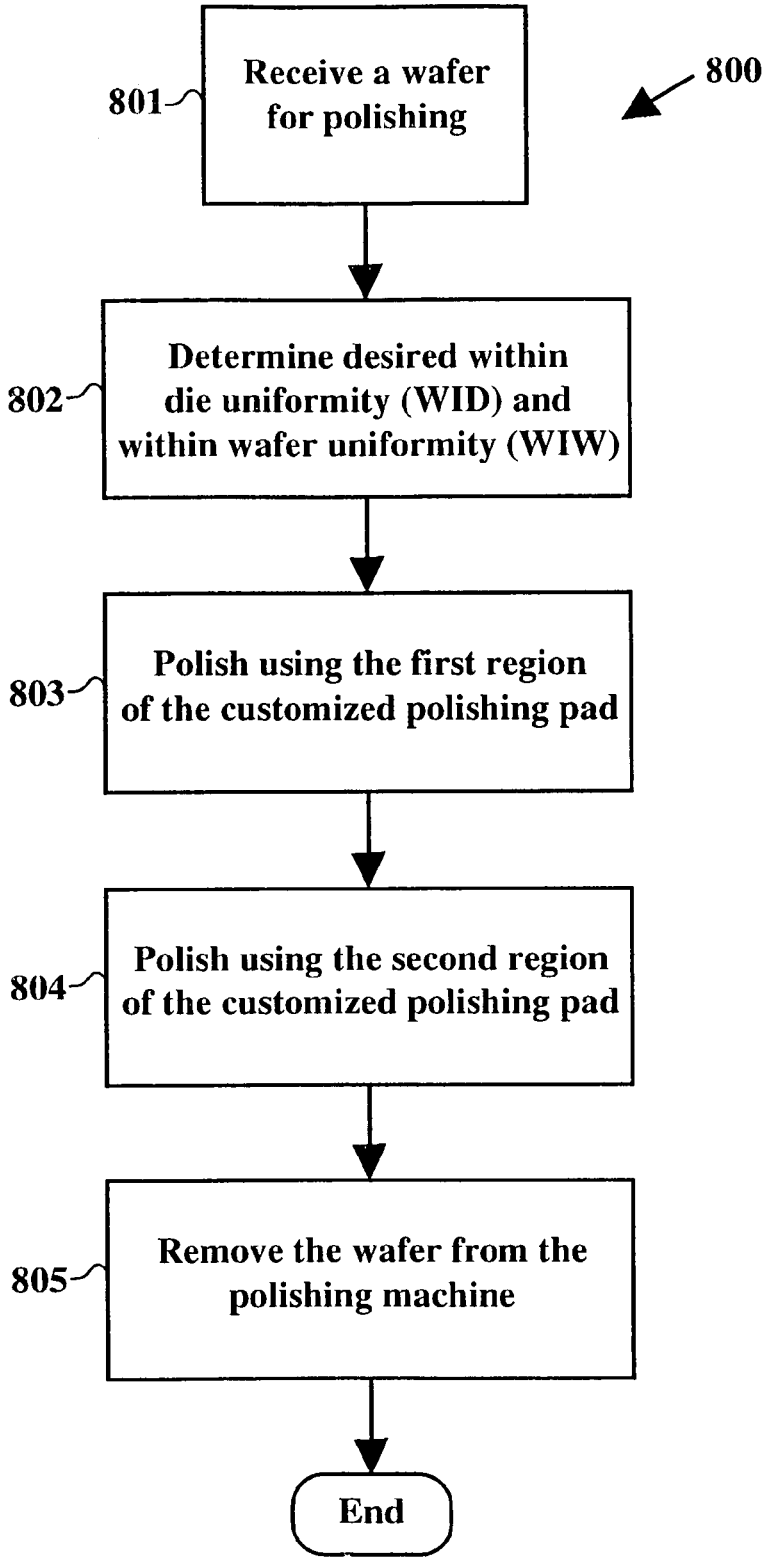
FIG. 8 is a flowchart of the steps performed in accordance with one embodiment of the present invention.

With reference now to FIG. 8, a flowchart 800 of the steps performed in accordance with one embodiment of the present invention is shown.

In step 801, a CMP machine having a customized polishing pad in accordance with the present invention receives a wafer to be polished. The CMP machine polishes wafers as part of an overall wafer fabrication process. Each wafer received for polishing includes a plurality of integrated circuit devices being fabricated on the wafer surface and is being polished to aid the photolithography process.

In step 802, the optimal WID and WIW uniformity for the particular wafer being polished is determined. WID uniformity depends upon the actual integrated circuit topography of the devices on the surface of the particular wafer. For example, areas with lower metal line density polish faster than areas with dense metal line topography. Thus, the desired WID and WIW uniformity varies with the types of devices on the wafer.

In step 803, once the optimal WID and WIW uniformity is determined, the wafer is polished using primarily the first region of the customized polishing pad of the present invention. In accordance with one embodiment, the first region has a first degree of hardness designed to achieve a predetermined polishing effect (e.g., a specific WID and WIW uniformity).

In step 804, the wafer is polished using primarily the second region of the customized polishing pad of the present invention. As described above, the second region has a second degree of hardness designed to achieve a predetermined polishing effect (e.g., a specific WID and WIW uniformity). Thus, the amount of time the wafer is polished using first region 201 and the amount of time wafer 311 is polished using second region 202 is controlled by CMP machine 300 to yield the optimized degree of WID uniformity and the optimized degree of WIW uniformity.

In step 805, the wafer is removed from the CMP machine. The wafer has been planarized to the optimal degree WID and WIW uniformity by the customized polishing pad of the present invention and is ready for the subsequent step in the fabrication process. The CMP machine is now ready to accept a subsequent wafer for CMP polishing. Because of the CMP machine uses the customized polishing pad of the present invention, the subsequent wafer will be optimally polished even if it contains integrated circuit devices having different topography and different metal line density in comparison to the previous wafer. Hence, the customized polishing pad of the present invention, by providing both a first region having a first hardness and a second region having a second hardness, provides a system which is readily tunable for each differing device on each differing wafer being processed. Although only two regions are recited in the steps of flowchart 800, the present method is also well suited to use with a customized polishing pad having a greater number of regions.

Thus, the present invention provides a readily optimized system for differing CMP process requirements. The system of the present invention is readily tunable for each differing device being polished in the CMP process. The system of the present invention is tailorable, depending upon the requirements of the particular devices being polished, without adversely impacting CMP process wafer throughput. Additionally, the system of the present invention has minimal added capitol equipment costs, does not require increased fabrication facility floor space, and does not adversely impact operator training expenses.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

The invention claimed is:

1. A polishing pad suitable for chemical mechanical polishing of wafers, comprising:

a circular base layer and an overlaying circular top layer, the overlying circular top layer forming the polishing surface of the polishing pad;

wherein the polishing surface of the polishing pad has at least two polishing regions thereon, the at least two polishing regions having distinct polishing characteristics, and wherein the at least two polishing regions are disposed on the polishing pad as concentric annular regions; and wherein the circular base layer comprises at least two concentric annular regions, each of the at least two base layer concentric annular regions disposed so as to underlie a corresponding one of the at least two polishing regions.

2. The polishing pad of claim 1, wherein each of the at least two base layer concentric annular regions has a hardness that is different from the others of the least two base layer concentric annular regions.

3. The polishing pad of claim 1, wherein each of the at least two base layer concentric annular regions has a thickness that is different from the others of the at least two base layer concentric annular regions.

4. The polishing pad of claim 1, wherein the circular top layer comprises at least two concentric annular regions, each of the at least two top layer concentric annular regions disposed so as to correspond with a single one of the at least two polishing regions; and each of the at least two top layer concentric annular regions having different polishing characteristics.

5. The polishing pad of claim 1, wherein the circular top layer comprises at least two concentric annular regions, each of the at least two top layer concentric annular regions disposed so as to correspond with a single one of the at least two polishing regions; and each of the at least two top layer concentric annular regions having different surface textures.

6. The polishing pad of claim 1, wherein at least two polishing regions are each of a size such that the wafer can be frictionally engaged with one of the at least two concentric annular polishing regions without simultaneously being engaged with others of the at least two concentric annular polishing regions.

7. A polishing pad suitable for chemical mechanical polishing of wafers, comprising:

a linear base layer and an overlying top layer, the overlying top layer forming the polishing surface of the polishing pad;

wherein the polishing surface of the polishing pad has at least two polishing regions thereon, the at least two polishing regions having distinct polishing characteristics, and wherein the at least two polishing regions are disposed on the polishing pad as parallel linear regions; and wherein the linear base layer comprises at least two parallel linear regions, each of the at least two base layer parallel linear regions disposed so as to underlie a corresponding one of the at least two polishing regions.

8. The polishing pad of claim 7, wherein the at least two polishing regions are each of a size such that the wafer can be frictionally engaged with one of the at least two parallel linear polishing regions without simultaneously being engaged with others of the at least two parallel linear polishing regions.

9. The polishing pad of claim 7, wherein each of the at least two base layer parallel regions has a thickness that is different from the others of the at least two base layer parallel linear regions.

10. The polishing pad of claim 7, wherein each of the at least two base layer parallel linear regions has a thickness that is different from the others of the at least two base layer parallel linear regions.

11. The polishing pad of claim 7, wherein the linear top layer comprises at least two parallel linear regions, each of the at least two top layer polishing regions disposed so as to correspond with a single one of the at least two polishing regions; and each of the at least two top layer parallel linear regions having different polishing characteristics.

12. The polishing pad of claim 7, wherein the linear top layer comprises at least two parallel linear regions, each of the at least top layer parallel linear regions disposed so as to correspond with a single one of the at least two polishing regions; and each of the at least two top layer parallel linear regions having different surface textures.

* * * * *